United States Patent [19]

Zawacki

[11] 4,261,060

[45] Apr. 14, 1981

[54] PANTS LIKE APPAREL HAVING SEAMLESS CROTCH-INNER PANEL

[76] Inventor: Barbara A. Zawacki, Rte. 1, Box 361, Rocky Point, N.C. 28457

[21] Appl. No.: 104,883

[22] Filed: Dec. 18, 1979

[51] Int. Cl.[3] ..... A41D 1/06

[52] U.S. Cl. ..... 2/227; 2/238

[58] Field of Search ..... 2/227, 228, 404, 407, 2/238

[56] References Cited

U.S. PATENT DOCUMENTS

| | | | |
|---|---|---|---|
| 1,737,882 | 12/1929 | Hatch | 2/227 X |
| 2,264,958 | 12/1941 | Smith | 2/227 |
| 2,753,567 | 7/1956 | Brice | 2/227 |

*Primary Examiner*—H. Hampton Hunter

*Attorney, Agent, or Firm*—Mills & Coats

[57] ABSTRACT

The present invention relates to a pants type apparel such as shorts, trousers or the like comprised of front and rear fabric panels that are closed about the crotch and inner leg area by a seamless panel that is referred to as a crotch-inner leg panel. Since the crotch-inner leg panel is seamless, the pants type apparel forms a very comfortable garment about the crotch and inner leg area that is particularly suited for athletic wear.

1 Claim, 3 Drawing Figures

PANTS LIKE APPAREL HAVING SEAMLESS CROTCH-INNER PANEL

The present invention relates to apparel, and more particularly to a pants type garment that is waist supported and which is provided with a seamless crotch-inner leg panel that extends from the leg sections of the apparel upwardly and around the crotch area.

BACKGROUND OF INVENTION

Typically pants, such as trousers, slacks and the like are designed such that the crotch and inner leg areas are provided with seams. Sometimes the cut of the pants type apparel is such that the crotch seam and even the upper leg seams are pulled close to the body of the wearer which makes for a relatively tight and binding fit about the crotch and the upper leg areas. This can result in an uncomfortable and binding fit even for ordinary use.

Greater discomfort, however, is realized when such pants type apparel are worn by individuals when active in sporting and outdoor activities. In such cases, the wearer may not be provided with ample freedom to move in the area of the crotch and inner legs, and this can result in the seams within the crotch and inner leg areas binding the individual's body adjacent the seams.

The problem is much more pronounced when the wearer is engaged in an activity such as bicycling, for example. It is not uncommon for a bicyclist to incur burns about inner leg areas after a substantial time of bike riding due to the fact that the inner leg seams continuously move about inner leg portions of the individual.

Therefore, there is a real need for a pants type apparel that does not bind, inhibit, and irritate the wearer's body in the crotch and inner leg areas as occurs with conventional crotch and inner leg seam designs, and which further enables the wearer's body to move unencumbered and unrestricted almost as if his or her body were unclothed.

SUMMARY OF INVENTION

The present invention entails a pants type apparel in the form of trousers, shorts, or the like, wherein there is provided a seamless crotch and inner leg panel that extends transversely, in a generally arched form, between the inner leg areas of the pants type apparel. This panel is designed so as to loosely enclose the crotch and inner leg area of the pants type apparel.

More specifically, the pants type apparel of the present invention comprises front and back fabric panels that are stitched together so as to generally surround a portion of an individual's body from the waist downwardly which in the case of shorts the legs thereof would terminate intermediately between the knee and the crotch. The front and back fabric panels would define an open area about the inner leg areas and crotch which is closed by the crotch-inner leg panel forming a part of the present invention.

Unlike conventional pants type apparel, the pants type apparel of the present invention because of the presence of the seamless crotch-inner leg panel, would not include seams along the inner leg portions nor in the crotch. In addition, the crotch-inner leg panel would be stitched or otherwise connected transversely between the front and rear fabric panels such that a portion thereof would generally drape down from front and rear seams, and wherein the crotch-inner leg panel would form a blousy type fit in and around the crotch and related areas.

It is, therefore, an object of the present invention to provide a pants type apparel such as trousers, slacks, shorts or the like with a seamless crotch-inner leg panel.

A further object of the present invention resides in the provision of a pants type apparel with a new and novel crotch design that will overcome the discomfort and irritating tendencies found in conventional crotch and inner leg apparel design.

Still a further object of the present invention is to provide a pants type apparel in the form of shorts that are designed for athletic type activities and wherein are specifically designed with a single piece crotch and inner leg panel that assures a comfortable and relatively loose crotch which further assures that the wearer's body will not be irritated by inner leg and crotch seams.

Another object of the present invention resides in the provision of a pants type apparel of the character described above which is relatively inexpensive and simple to make.

Other objects and advantages of the present invention will become apparent from a study of the following description and the accompanying drawings which are merely illustrative of the present invention.

DESCRIPTION OF PREFERRED EMBODIMENT

Figure 1:
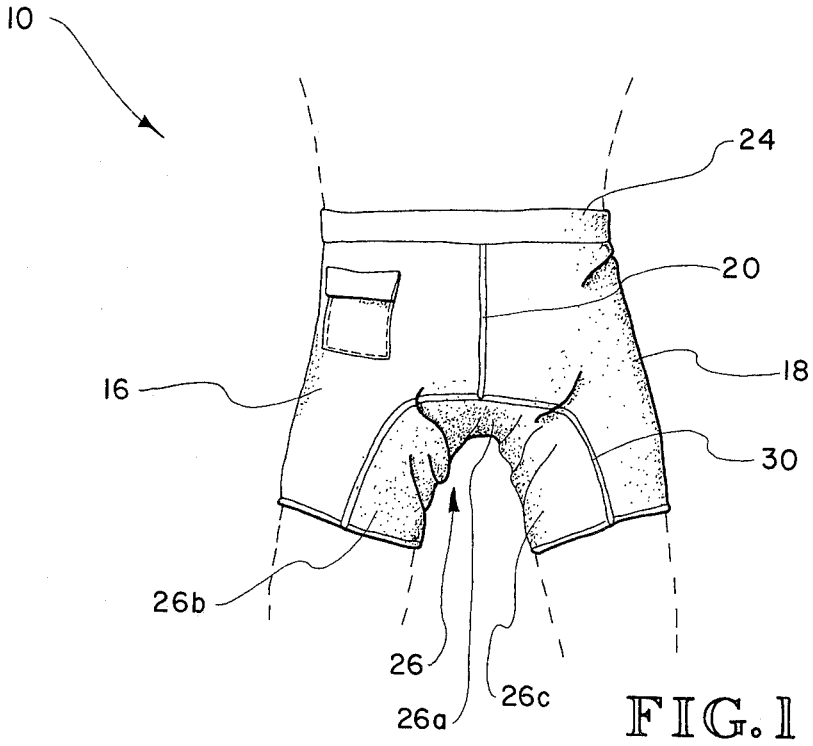
FIG. 1 is a rear elevational view of the pants type apparel of the present invention.

With further reference to the drawings, the pants type apparel of the present invention is shown therein and indicated generally by the numeral 10. In the preferred embodiment illustrated, the pants type apparel 10 is disclosed in the form of shorts as the lower leg seams terminate intermediately between the crotch and the knee. It is to be understood, however, that the pants type apparel of the present invention could be in the form of conventional full length trousers or the like.

Viewing the construction of the shorts 10 in more detail, it is seen that the same comprises a front fabric panel that is made up of two quarter front panels 12 and 14. Likewise a rear fabric panel is provided and the same is made up of quarter rear panels 16 and 18. These quarter panel pieces are cut from a sheet of desired fabric such as cotton, poplin, demin, or any other suitable fabric. Details of the specific pattern and the method of cutting is not shown herein because such is not per se material to the present invention, and further because such techniques are well appreciated by those skilled in the art.

Figure 2:
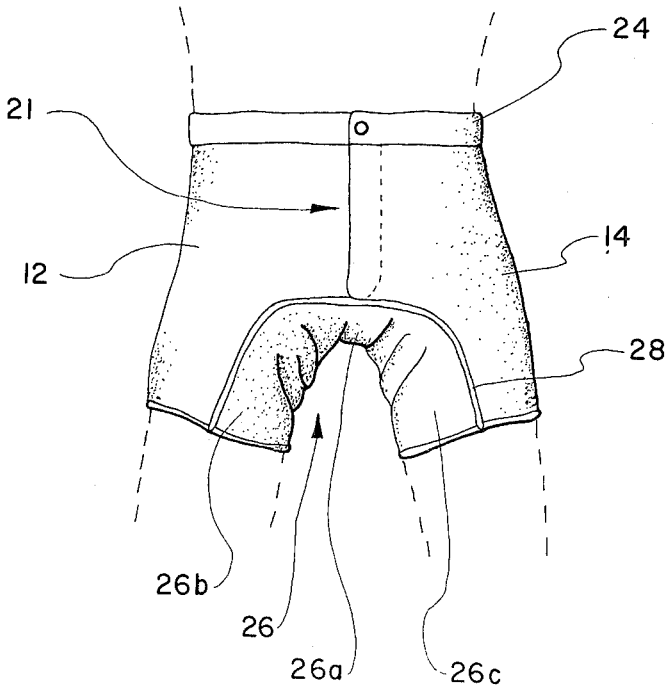
FIG. 2 is a front elevational view of the pants type apparel of the present invention.

It should be pointed out that in connecting or stitching the front quarter panels and the rear quarter panels, that the respective quarter panel pieces are placed such that their inner sides are together and are stitched together along the center edge. It is appreciated that this will result in a back seam 20 and a front seam that will lie in the general area of a front fly opening generally referred to by the numeral 21 in FIG. 2.

Figure 3:
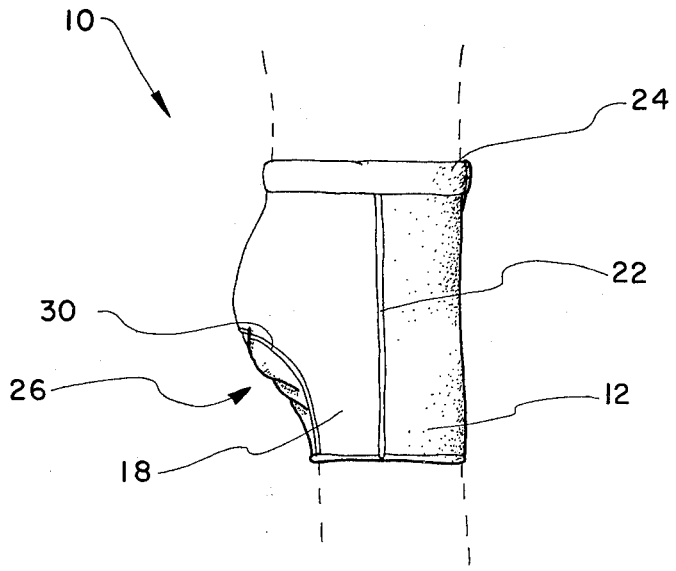
FIG. 3 is a side elevational view of the pants type apparel of the present invention.

After this, the front and rear fabric panels are stitched together about side seams 22, as illustrated in FIG. 3.

In addition, the pants type apparel 10 of the present invention is provided with a waist band assembly 24 that is secured around the top of the front and rear fabric panels. Details of the waist band 24 are not dealt with herein in detail because the pants type apparel of the present invention could obviously utilize various types of waist bands known in the apparel art today.

It is appreciated that once the front and rear fabric panels are secured together that a surrounding garment is defined that would generally be open about the crotch and inner leg areas. As viewed in FIGS. 1 and 2, it is seen that the rear fabric panel, comprised of quarter panels 16 and 18, is cut such that the lower back thereof terminates about a line that extends in a generally inverted U-fashion about the back of the shorts type apparel 10. Likewise, in the case of the front fabric panel, the same is cut such that it terminates about another line that extends generally in an inverted U-fashion from the leg sections of the apparel up across the lower front pelvic area.

To close the crotch and inner leg areas of the apparel forming the present invention, a seamless crotch-inner leg panel is stitched between the front and rear fabric panels as illustrated in the drawings such that the crotch-inner leg panel 26 extends tranvsersely across the crotch area and between the inner leg areas of the apparel. As seen in the drawings, the crotch-inner leg panel is designed so as to loosely fit around the crotch area and inner leg area in a blousy fashion so as to not restrict and encumber the crotch and inner leg area of the individual's body.

Viewing the crotch-inner leg panel 26 in more detail, it is seen that the same includes a crotch area **26*a* and a pair of inner leg areas 26*b* and 26*c***.

It is seen that once stitched and connected to the front and rear fabric panels that a front seam 28 is defined about the area where the front panel meets and connects with the crotch-inner leg panel 26, and a back seam 30 where the back fabric panel connects to the crotch-inner leg panel 26.

From the foregoing specification, it is appreciated that the present invention presents a new and unique pants type apparel inasmuch as it includes a specially designed combination crotch-inner leg panel that is seamless and which is spaced comfortably about the body in order that the wearer may move his or her body about this area in comfort. Of particular significance is the fact that the crotch-inner leg panel is designed for particular use as athletic wear such as bicycling where the seat fits tightly in the crotch area between the individual's legs. Because the crotch-inner leg panel 26 is seamless it follows that there are no inner leg seams to irritate the legs of the individual wearing the pants type apparel 10 of the present invention. Further because the crotch is without a seam, there is no irritation caused by crotch seams.

Finally it is appreciated that the pants type apparel of the present invention is desirable and advantageous because they are relatively simple and inexpensive, and would be easy to make.

The terms "upper", "lower", "forward", "rearward", etc. have been used merely for the convenience of the foregoing specification and in the appended Claims to describe the pants type apparel having a seamless crotch-inner leg panel and its parts as oriented in the drawings. It is to be understood, however, that these terms are in no way limiting to the invention since the pants type apparel having a seamless crotch-inner leg panel may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A pants type apparel such as shorts, trouser, or the like with a permanent seamless crotch-inner leg panel stretched across the crotch area between inner leg areas of the apparel, comprising: front and back fabric panels interconnected so as to define an apparel piece that generally surrounds portions of one's body below the waist with said connected front and back fabric panels having open crotch and inner leg areas, said front fabric panel including a center pelvic area that is cut upwardly from one leg area, generally horizontally across the center front pelvic area, and then downwardly about the other leg area, and wherein the back fabric panel is likewise cut in that the same is cut upwardly from one leg area, then generally horizontally across the back rump area, and then downwardly toward the other leg area such that said cuts about both front and back fabric panels are of a generally inverted U-shape; a permanent one piece seamless crotch-inner leg panel connected between the open inner leg areas of said front and back panels such that the crotch-inner leg panel extends transversely continuously from one inner leg area, across the crotch, to the other inner leg area, and wherein the seamless crotch-inner leg panel cooperates with said front and back fabric panels to form a pair of leg sections with the crotch-inner leg panel extending about an inner portion of each leg section, and further wherein said crotch-inner leg panel extends across the crotch area between said inner leg portions in a generally inverted U-shaped fashion and in such a manner that because of the seamless nature of said crotch-inner leg panel the defined apparel is without seams about the inner leg portions and the crotch; and wherein said seamless crotch-inner leg panel comprises four separate terminal edges including two terminal side edges that conform in shape to said cuts formed about both front and back fabric panels that define said open crotch area, and wherein said crotch-inner leg panel further includes opposite leg joining terminal edges about the two remaining edges of the seamless crotch-inner leg panel with said leg joining terminal edges being of substantial length in order to make up approximately one-half of the leg circumference of said apparel where the crotch-inner leg panel joins the leg area of said front and back fabric panel; generally inverted U-shaped seam means formed about the front and back of said apparel for interconnecting said terminal side edges of said crotch-inner leg panel to the generally inverted U-shaped cuts formed about said front and back fabric panels, said inverted U-shaped seam means formed about the back of said apparel including a seam extending generally upwardly from both the mid-rear leg areas of the formed apparel and inwardly across the rump area of said apparel to form said generally inverted U-shape, while said seam means includes a front seam of a generally inverted U-shape which extends upwardly from both the front mid-leg areas of the formed apparel and inwardly across the pelvic area so as to define said generally inverted U-shaped front seam.

* * * * *